US006669112B2

(12) United States Patent
Reetz, III et al.

(10) Patent No.: US 6,669,112 B2
(45) Date of Patent: Dec. 30, 2003

(54) AIR ASSISTED SPRAY SYSTEM WITH AN IMPROVED AIR CAP

(75) Inventors: Eric F. Reetz, III, Broofield, CO (US); Christopher Strong, Northglenn, CO (US); Vernon Lynn Weaver, Loveland, CO (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/682,935

(22) Filed: Nov. 1, 2001

(65) Prior Publication Data

US 2002/0148910 A1 Oct. 17, 2002

Related U.S. Application Data

(60) Provisional application No. 60/283,001, filed on Apr. 11, 2001.

(51) Int. Cl.[7] ..... B05B 1/28

(52) U.S. Cl. ..... 239/296; 239/290; 239/299

(58) Field of Search ..... 239/296, 290, 239/299

(56) References Cited

U.S. PATENT DOCUMENTS 4,386,739 A * 6/1983 Kwok ..... 239/296
4,842,203 A * 6/1989 Kuhn et al. ..... 239/291
5,344,078 A * 9/1994 Fritz et al. ..... 239/290

* cited by examiner

*Primary Examiner*—Robin O. Evans
(74) *Attorney, Agent, or Firm*—Ziolkowski Patent Solutions Group, LLC

(57) ABSTRACT

An air cap for an air-assisted spray nozzle assembly of a spray gun system is disclosed. The air cap has a body formed by a housing having an inner surface which includes a plurality of apertures configured to pass a pressurized medium therethrough. The plurality of apertures includes at least one non-circular bounded discharge orifice through which the pressurized medium passes through providing improved air flow through the air cap.

21 Claims, 5 Drawing Sheets

AIR ASSISTED SPRAY SYSTEM WITH AN IMPROVED AIR CAP

CROSS REFERENCE TO RELATED APPLICATIONS

This application claims the benefit of prior U.S. Provisional Application Serial No. 60/283,001 filed Apr. 11, 2001 and entitled "AIR ASSISTED SPRAY SYSTEM WITH AN IMPROVED AIR CAP".

BACKGROUND OF INVENTION

The present invention relates generally to an air assisted spray system and more particularly, to an improved air cap for an air assisted spray gun system.

Spray gun systems for atomizing a pressurized fluid stream with a pressurized gas, such as air, are known in the art. In such systems, the fluid stream is intermixed with pressurized air to breakdown or atomize the fluid stream into very fine particles. The fluid particle breakdown can occur as the fluid is exhausted from an apertured air cap positioned at a nozzle discharge end of the spray gun system.

From efficiency and economic operating viewpoints, it is desirable that such particle breakdown be effected using relatively low air flow rates and pressure. Heretofore, this has created problems. In particular, spray tips or air caps which provide efficient and economic operation are generally relatively complex in design, and hence, are relatively expensive to produce.

Moreover, air caps are also limited in terms of their versatility. For example, such air caps are typically designed for use with a specific air assisted nozzle body configuration. Accordingly, multiple air caps must be provided for each type of nozzle assembly. The relatively high costs of such air caps, therefore, only exacerbates the problem of readily achieving the goal of providing efficient and effective operation of the spray gun system.

The ability to achieve peak air flow volume from the air cap is complicated by numerous considerations. First, during operation of the spray gun system, the pressurized air flow to the air tip can cause back pressure problems within the system. Second, the transition between component parts of the spray gun system, especially at the conjuncture between the air cap and the air passages within the body of the spray gun system can cause turbulence problems, which can adversely affect pressurized air flow to the air cap. The ability to accurately machine discharge orifices or apertures in relatively thin walled parts or sections of parts is also critical for achieving accurate impingement between the pressurized air and the fluid stream exhausted from the air cap.

It would therefore be desirable to have an apparatus and system which is relatively inexpensive to manufacture and capable of minimizing back pressure and turbulence within the spray gun system, particularly in the transition area of the air cap and the air flow passages leading from the spray gun system.

BRIEF DESCRIPTION OF INVENTION

The present invention is directed to an apparatus and system having apertures configured to discharge pressurized gas toward a pressurized fluid to form a oval-spray pattern.

An improved air cap for an air-assisted spray nozzle assembly of a spray gun system is provided. The air cap includes a center aperture for accommodating an aperture nozzle or tip from whence a pressurized liquid is sprayed.

The air cap further includes a plurality of apertures within the air cap housing that directs a pressurized medium toward the aperture tip for atomizing and shaping the liquid flow spraying from the nozzle.

In accordance with one aspect of the present invention, an air cap for an air-assisted spray nozzle assembly includes a body form by a housing having an inner surface which defines a plurality of apertures. The plurality of apertures is configured to pass a pressurized medium, such as air, therethrough. The plurality of apertures includes at least one non-circular orifice through which the pressurized medium passes through.

In accordance with another aspect of the present invention, an air cap for a spray nozzle assembly includes a housing having an inlet end engageable to a discharge end of a spray gun, and an outlet end on an opposite side of the inlet end. The outlet end has a plurality of apertures in an inside surface of the outlet end such that at least one of the plurality of apertures has a non-circular boundary on an inside surface of the outlet end.

In a further aspect of the present invention, a spray gun system is disclosed. The system includes a gun body adapted to receive a pressurized fluid and discharge the pressurized fluid at a nozzle end. The system also includes a nozzle assembly connected to a nozzle end of the gun body. The nozzle assembly includes an air cap having a pair of non-circular apertures on an inside surface of the air cap. Each of the non-circular apertures are in communication with a plurality of discharge apertures that discharge pressurized gas toward a pressurized fluid to form a generally oval-shaped spray pattern.

In yet another aspect of the present invention, an air cap for an air-assisted spray nozzle assembly includes a body having a cylindrical sidewall and an end wall connected to the cylindrical sidewall. The end wall has an inside surface, an outside surface and at least one aperture therein. The inside surface of the end wall has a non-circular opening in fluid communication with the at least one aperture. The outside surface of the end wall has a plurality of openings in fluid communication with the at least one aperture.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
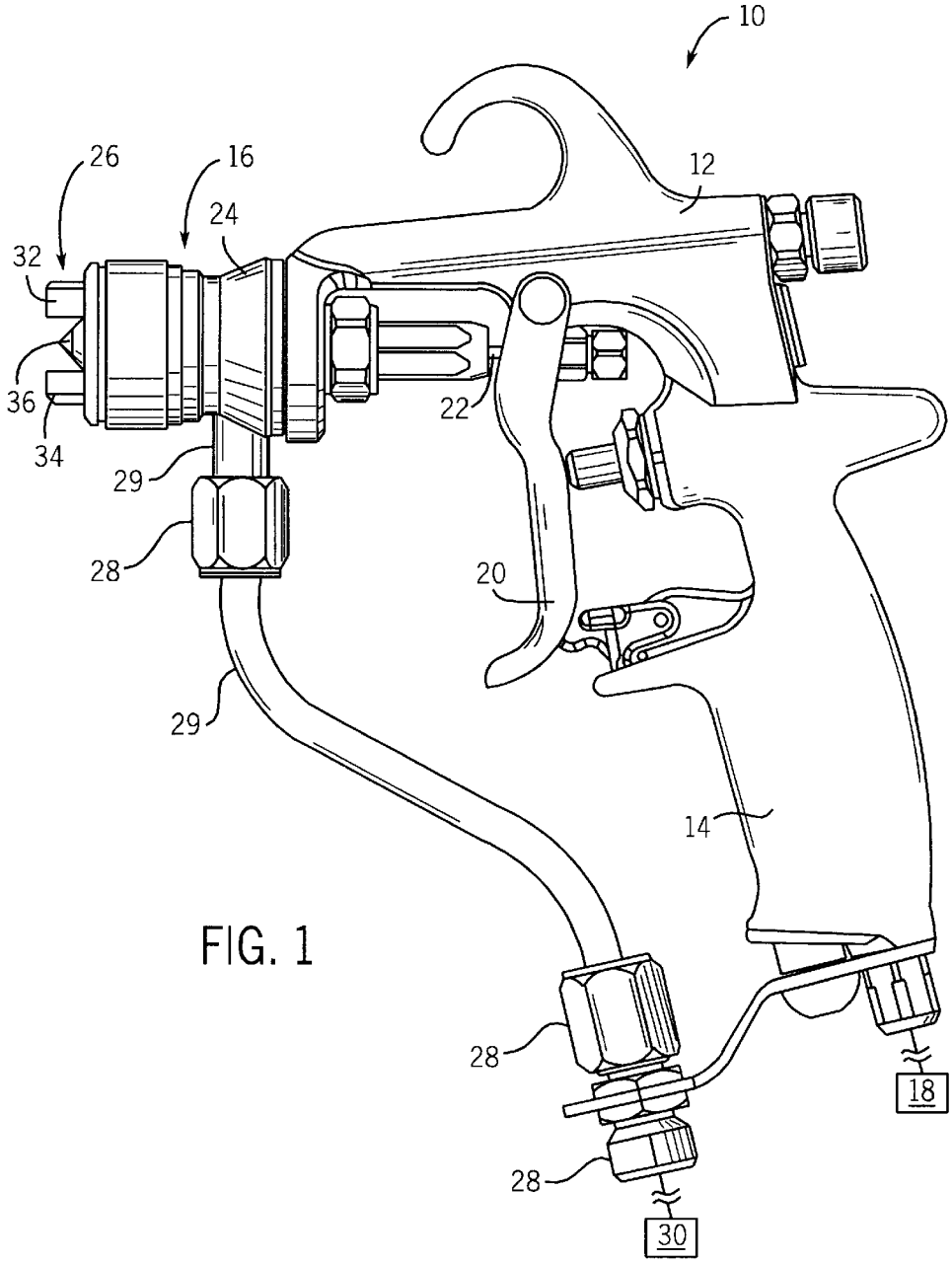
FIG. 1 is a side elevational view of a spray gun system.

Referring to FIG. 1, an air assisted spray gun system and spray gun 10 is shown. The spray gun 10 includes a body portion 12, a depending grip 14, and an air-assisted spray nozzle assembly or nozzle discharge end 16. The grip 14 and body portion 12 of the spray gun 10 have internal passages for communicating a medium, such as air, from a pressurized source 18 to the nozzle discharge end 16 of the spray gun 10. The spray gun 10 further includes a manually operated trigger 20 pivotally connected to the body portion 12 and a valve stem 22. The trigger 20 is used for selectively controlling the flow of pressurized fluid to be atomized at the nozzle discharge end 16 of the spray gun 10. While the present invention is described in connection with a particular illustrated spray gun system, it will be readily appreciated that the present invention is equally applicable to other spray gun systems having different configurations.

The nozzle discharge end 16 of the spray gun system 10 includes a gun head 24 and an air cap 26. Connectors 28 and feed lines 29 connect the gun head 24 to a suitable pressurized fluid source 30, such as a paint or other liquid. The air cap 24 has a pair of air horns 32, 34 that are formed to direct a pressurized medium toward an apertured tip 36 of the nozzle assembly 16, which is configured to discharge the fluid from the pressurized fluid source 30. That is, the pressurized medium is directed from the air horns 32, 34 to atomize and form a spray pattern of a liquid flow stream delivered to and exhausted from the apertured tip 36 into very fine particles in a preferred pattern so as to maximize spray gun efficiency.

Figure 2:
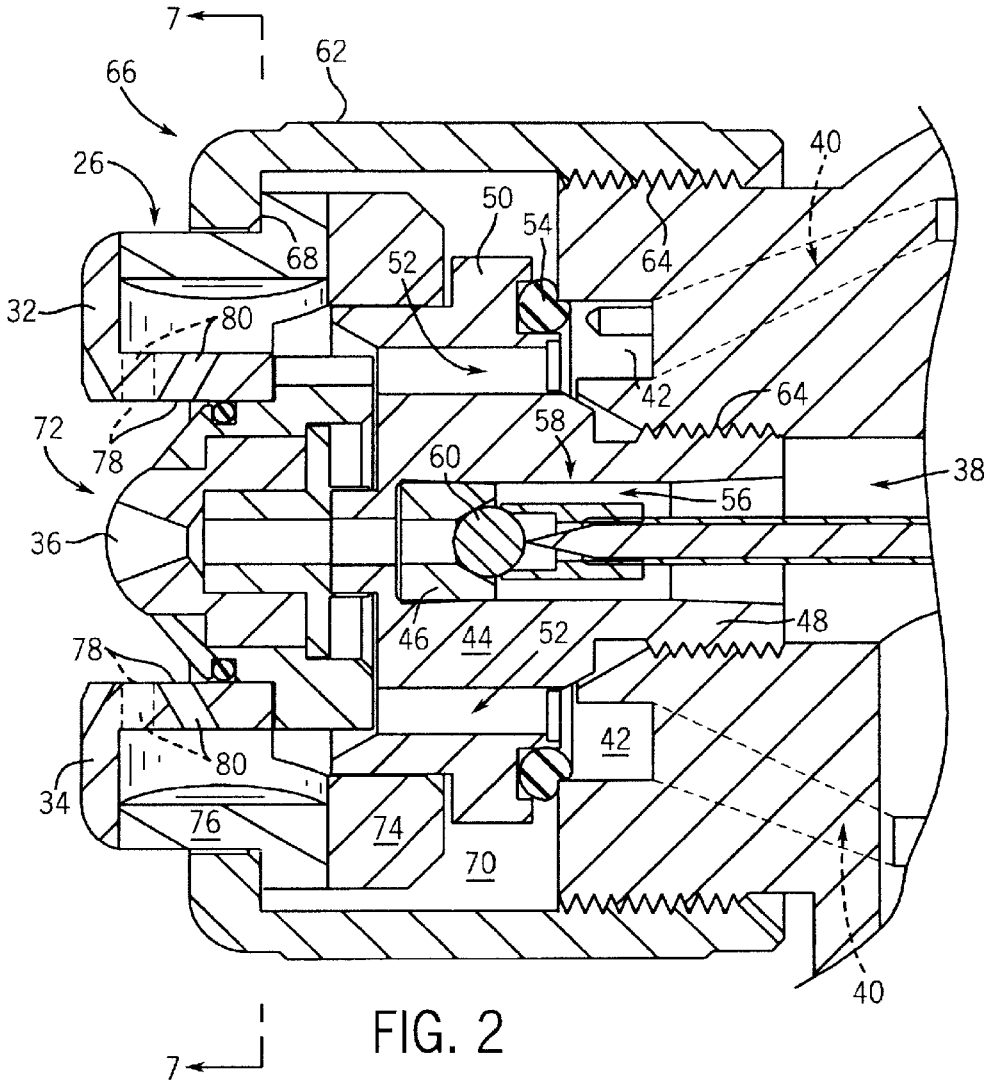
FIG. 2 is an enlarged longitudinal sectional view of a nozzle discharge end of the spray gun system of FIG. 1.

Turning to FIG. 2, an enlarged longitudinal sectional view of a nozzle discharge end of the spray gun system of FIG. 1 is shown. The gun head 24 is formed with a generally centralized liquid passage 38 which communicates with the pressurized fluid source 30. The gun head 24 further has a series of longitudinally extending atomizing passages 40 communicating with the internal passages in the body portion 12 of the spray gun 10. The longitudinally extending passages 40 open at a distal end to an annular chamber 42 in the gun head 24.

In the illustrated embodiment, the gun head liquid passage 38 directs pressurized fluid or paint to a fluid seat assembly 44 connecting to the apertured tip 36 of the spray gun 10. Seat assembly 44 includes a fluid seat 46 which is supported and extends from the gun head 24. An upstream end of the fluid seat 46 is configured with an externally threaded cylindrical extension 48 which is threadably coupled within a distal end of the generally centralized liquid passage 38 in the gun head 24. Between proximal and distal ends thereof, to fluid seat 46 is configured with an enlarged radial flange 50. Moreover, the fluid seat 46 has a series of longitudinally extending atomizing passages 52 which communicate with and receive a pressurized medium or gas from the annular chamber 42 in the gun head 24. A seal 54 is entrapped and seals between the fluid seat radial flange 50 and the gun head 24 and is disposed radially outwardly from the annular chamber 42 and inlet ends of each atomizing passage 52 defined by fluid seat 46. In the exemplary embodiment seal 54 is configured as a conventional elastomeric O-ring seal.

In FIG. 2, the fluid seat 46 has a generally centralized, longitudinally extending fluid passage 56 which, at a proximal end, communicates with the fluid passage 38 in the gun head 24 and at the distal end directs pressurized fluid, such as paint to the tip 36 from whence fluid is atomized. A valve 58 is intermediate the proximal and distal ends of passage 56, and has a spherical valve element 60 which engages and seals against the fluid seat 46. The elongated linearly displaceable valve stem 22 is operably connected, at one end, to the valve element 60 and is operably connected at an opposite end to the trigger 20 of the spray gun system 10.

Still referring to FIG. 2, the air cap 26 is mounted and held in place by a retaining ring 62. Toward a rear end of the retaining ring 62, internal threads 64 are provided for engaging the gun head 24. At the other end of the retaining ring 62, an inwardly turned lip 66 on the ring 62 captures and cooperates with a radial step 68 of the air cap 26 thereby releasably affixing and positioning the air cap 26 at the nozzle discharge end 16 of the spray gun system 10. As illustrated, the retaining ring 62 operably combines with the fluid seat 46 to define a chamber 70 therebetween. As will be appreciated, other means for affixing and positioning the air cap 26 at the nozzle discharge end 16 of the spray gun system 10 would equally suffice without detracting or departing from the spirit and scope of the present invention.

The air cap 26 defines a generally centralized axial opening or center aperture 72 for discharging the pressurized fluid and has a first generally cylindrical portion 74 which is axially aligned and generally concentric with a second generally cylindrical portion 76. Upon assembly of the spray gun system 10, the first generally cylindrical portion 74 of the opening 72 is sized to fit snugly about and along a lengthwise portion of the fluid seat 46 on a side of the radial flange 50 opposite from the seal 54. During tightening of the retaining ring 62 to the spray gun 10, seal 54 is compressed to effect a fluid tight seal between the gun head annular chamber 42 and the inlet end of each atomizing passage 52 defined by fluid seat 46. The second lengthwise portion 76 of the opening 72 is sized to snugly accommodate the nozzle tip 36 lengthwise therein. The air horns 32, 34 of the air cap 26 have a plurality of openings 78 having passages 80, some of which are non-parallel to one another.

Figure 3:
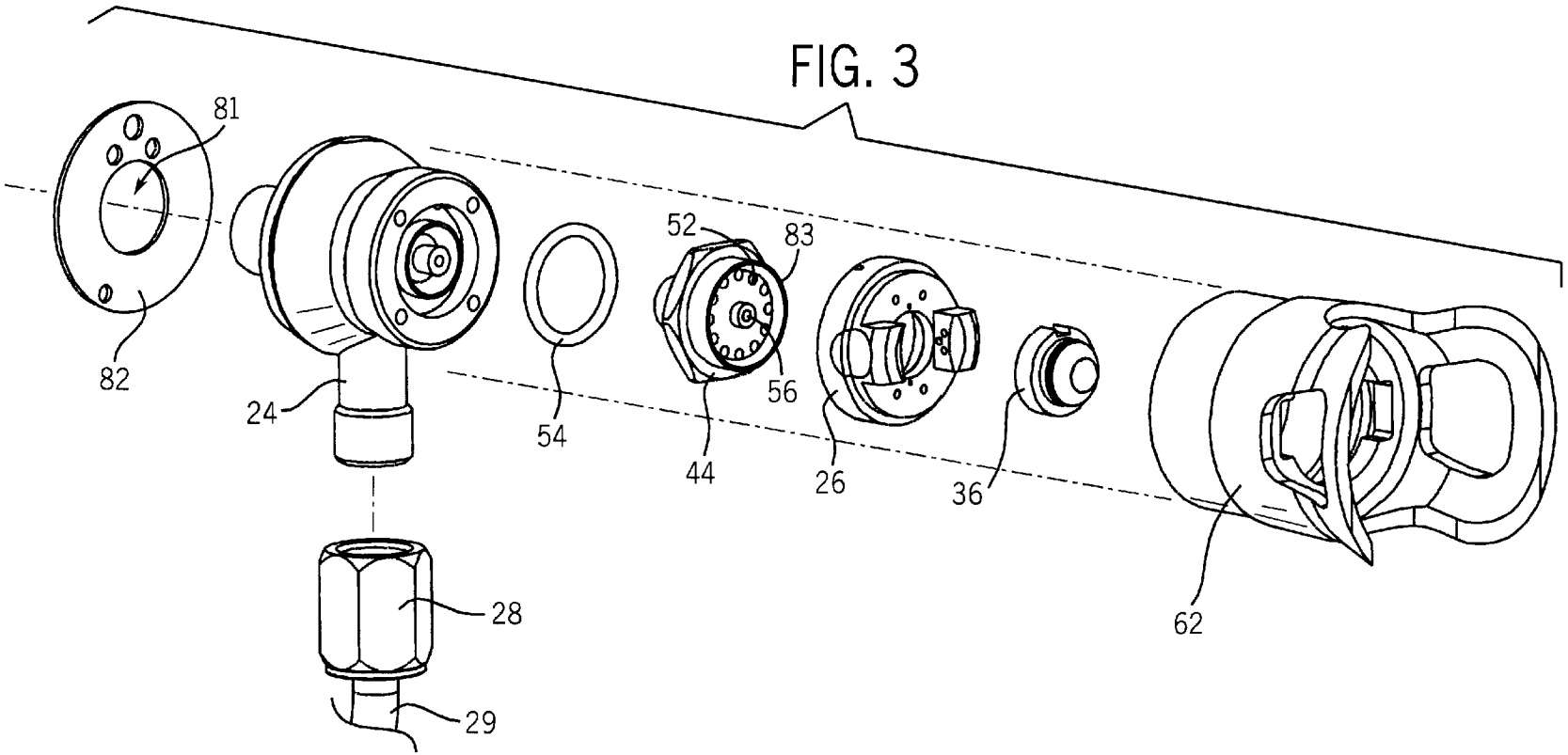
FIG. 3 is an exploded perspective view of the nozzle discharge end of the spray system of FIG. 1.

FIG. 3 shows an exploded view of the nozzle discharge end 16 of the spray system of FIG. 1. The feed line 29 and connector 28 are secured to the gun head 24, which receives the valve stem 22 shown in FIG. 1 through center opening 81 of washer 82. The O-ring seal 54 seals the seat assembly 44, having atomizing passages 52 and fluid passage 56 therein, to the gun head 24 to effect the air tight seal. The air cap 26 engages a discharge end 83 of the seat assembly 44 of the spray gun 10, and has the tip 36 also secured thereto to discharge the pressurized fluid communicated through line 29. Retaining ring 62 secures the tip 36, air cap 26, and seat assembly 44 to the gun head 24 and is configured to assist with controlling the directional flow of the pressurized fluid sprayed from the tip 36.

Figure 4:
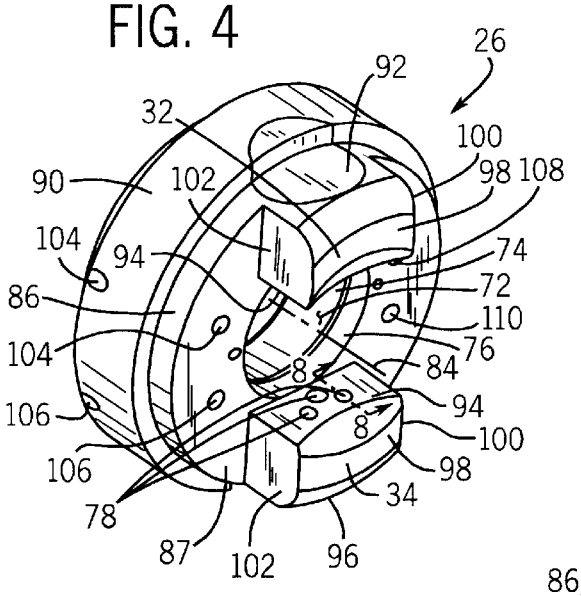
FIG. 4 is a perspective view of a forward portion of an air cap in accordance with the present invention.
Figure 5:
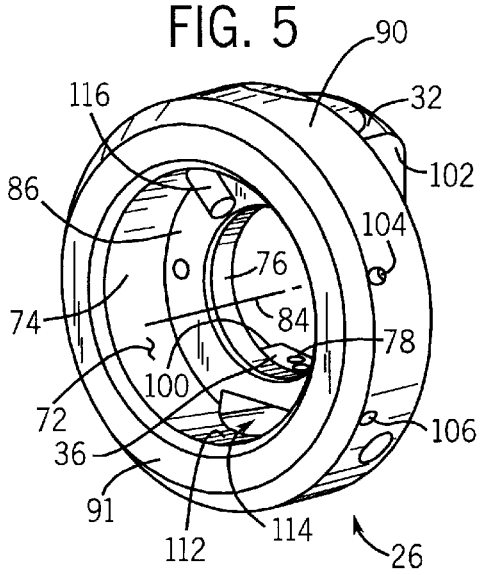
FIG. 5 is a perspective view of a rearward portion of the air cap of FIG. 4.

FIGS. 4 and 5 are perspective views of the front and back of the air cap 26. The opening 72 is axially aligned with an axis 84 and the first and second cylindrical portions 74, 76 respectively. The first cylindrical portion 74 has a different diameter than the diameter of the second cylindrical portion 76 thereby defining a radial wall 86 extending therebetween. The radial wall 86 has an outlet end 87 for discharging the pressurized medium into the air horns 32, 34. The two air horns 32, 34 extend outward and away from an outer side of the radial or end wall 86, in a direction generally parallel to the axis 84. Preferably, the air horns 32,34 are integrally formed to the radial wall 86 of a housing or body 90 of the air cap 26, and are adapted to receive a plug 92 upon completion of air cap machining. The housing 90 further includes an inlet end 91 engageable to the discharge end 83 of the spray gun 10, and has the inlet end 91 connected to the outlet end 87.

Each air horn 32, 34 is configured with inner and outer walls 94 and 96, respectively, disposed at different radial distances from the axis 84 of the air cap 26. Preferably, the inner walls or discharge end 94 of the air horns 32, 34 extend in a generally parallel relation relative to each other and, in the illustrated embodiment, in generally parallel relation to the axis 84 of the air cap 26. The inner walls 94 also include the plurality of discharge openings 78 which are configured to discharge the pressurized medium. As will be appreciated, the radial disposition of wall 94 is defined by the inner diameter of the second cylindrical portion 76 of the opening 72. Furthermore, the radial disposition of the outer wall 96 is defined by the outer diameter of the housing 90. Walls 94 and 96 are joined to each other by an end wall 98. Opposed and generally parallel side walls 100 and 102 span the radial distance between the inner and outer walls 94 and 96, respectively.

The air cap 26 further includes apertures 104, 106 and 108, 110 disposed at opposed sides of the longitudinal axis 84 between air horns 32, 34 of the air cap 26. Inlet ends of the passages 104, 106 and 108, 110 open to and receive the pressurized medium from the air chamber 70. Outlet or distal ends of the fluid passages 104, 106 and 108, 110 nearest the air horns 32, 34 open to and direct a pressurized stream toward the apertured tip 36 during operation of the spray gun 10. The pressurized streams directed by the fluid passages 104, 106 and 108, 110 toward the apertured tip 36 provide a cleansing effect to the tip 36 during spray gun operation.

Referring specifically to FIG. 5, an inner surface 112 of the housing 90 defines a non-circular orifice 114 of the air cap 26. Preferably, the air cap has two non-circular orifices 114 that are configured to discharge the pressurized medium through the air horn openings 78. The air cap also includes a stem 116 connected to the inner surface 112 during the machining process of the air cap 26.

Figure 6:
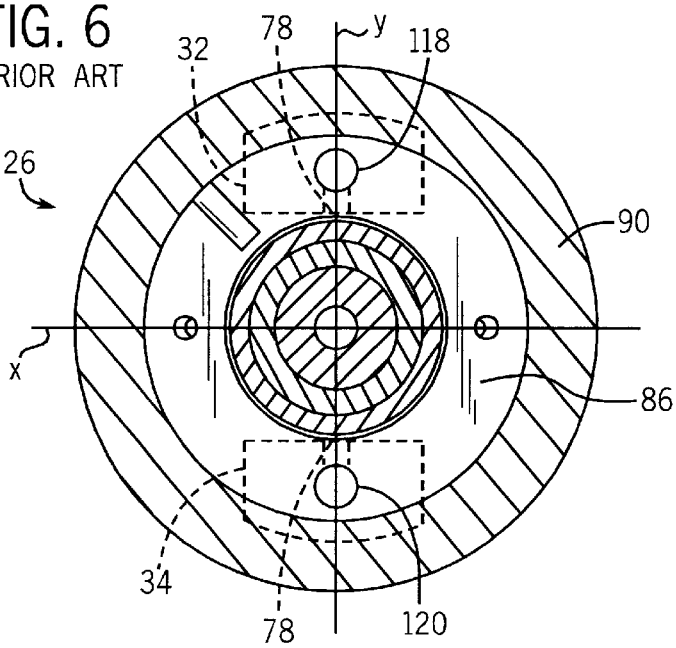
FIG. 6 PRIOR ART
FIG. 6 is a sectional view of a prior art air cap.
Figure 7:
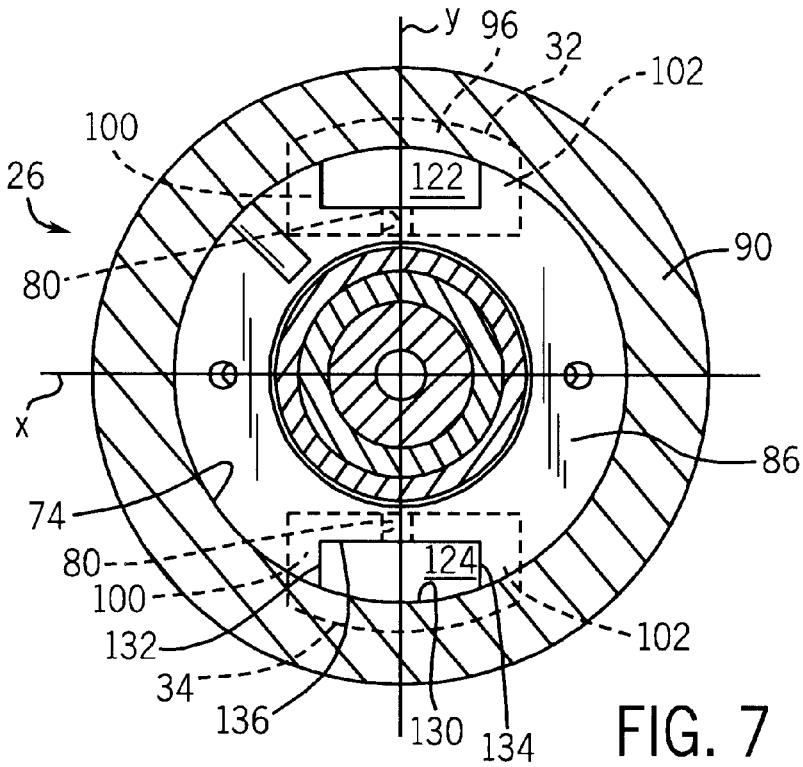
FIG. 7 is a sectional view taken along line 7—7 of FIG. 2.

FIGS. 6 and 7 show sectional views of a prior art air cap (FIG. 6) and the cap 26 of the present invention (FIG. 7). The prior art circular orifices 118, 120 of radial wall 86 of FIG. 6 are aligned along a Y-axis and are symmetrically disposed about an X-axis that equally segments the housing 90. The orifices 118, 120 have a circular inlet for discharging the pressurized medium through the air horn openings 78 of air horns 32, 34.

In accordance with the present invention as best shown in FIG. 7, the inner surface 112 of the housing 90 defines a pair of opposed, uniquely configured apertures 122, 124 having non-circular boundaries in the radial wall 86. The non-circular apertures 122, 124 are configured to pass a pressurized medium therethrough, and in one embodiment have the pair of apertures 122, 124 arranged on opposed sides of longitudinal axis 84. In another embodiment, the non-circular boundary is an elliptical boundary. The non-circular boundary is defined by an arcuate wall 130 contiguous with the cylindrical sidewall 74, a pair of opposing sidewalls 132, 134 extending inwardly from the cylindrical sidewall 74 and a wall 136 connecting the pair of opposing sidewalls 132, 134. Preferably, the pair of opposing sidewalls 132, 134 form a 90° angle at the connections to the cylindrical sidewall 74 and wall 136. The passages or cavities 80 in the air horn housings 32, 34 are in communication with the discharge orifices 126, 128. In the preferred form, the apertures 122, 124 longitudinally extend within the air horn housings 32, 34. Each of the apertures 122, 124 opens to and receives the pressurized medium from the atomizing passages 52 of the fluid seat 46. The apertures 122, 124 extend longitudinally and preferably parallel to the axis 84 of the air cap 26 until proximate to the end wall 98 of each air horn housing 32, 34. The apertures 122, 124 cooperate relative to each other to direct a high volume flow of discharge pattern shaping atomizing medium or air from a respective passage 80 toward each other and toward the nozzle tip 36 at the discharge end 16 of the spray gun 10. In one embodiment, the apertures 122, 124 can have an elliptical-like cross-section or boundary.

The apertures 122, 124 are configured to communicate with the passages 80 in the air horns 32, 34. The passages 80 exhaust the pressurized medium from the plurality of air horn openings 78. Preferably, at least one passage is perpendicular to the non-circular apertures 12, 124 for each air horn 32, 34 to direct the pressurized medium toward an opposing air horn.

Figure 8:
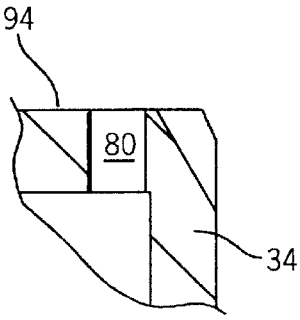
FIG. 8 is a partial sectional view taken along line 8—8 of FIG. 4.

FIG. 8 is a partial sectional view taken along line 8—8 of FIG. 4 showing a perpendicular passage 80 in air horn 34, which is also perpendicular to the air horn's inner wall 94. Preferably, each air horn 32, 34 has two parallel passages perpendicular to the discharge orifice of the air horn, and one passage that is non-parallel to the two parallel passages that discharge the pressurized medium or gas toward the fluid to form a generally oval-shaped spray pattern.

The unique configuration of the non-circular boundary of the air cap 26 advantageously increases the volume and velocity of atomizing air or pressurized medium exhausted from the air cap 26 thereby allowing for enhanced air impingement relative to the liquid passing from the apertured tip 36. Accordingly, the efficiency and effectiveness of the spray gun 10 is significantly enhanced with minimum design changes to the spray gun 10 in a cost efficient manner.

The unique configuration of the apertures 122, 124 within the air cap 26 provide another advantage of significantly reducing air turbulence in the transition area between the fluid seat 46 and the air cap 26. That is, the cross-sectional or elliptical-like configuration of the discharge orifices 126, 128 promotes a smooth flow of atomizing air or medium from the fluid seat 46 to the air horns 32, 34 relative to prior art circular geometries.

Another advantage of having non-circular apertures is that machining and manufacture of the air cap 26 is easier. With the present invention, the distance or wall thickness separating the inner wall 94 having the plurality of openings 78 and the apertures 122, 124 can be maximized by elongating the cross-sectional configuration along the X-axis. As will be appreciated by those skilled in the art, maximizing the thickness of the inner wall 94 facilitates machining of the openings 78 extending from the passages 80 and enhances impingement of the atomized medium against the pressurized fluid sprayed from the nozzle end 16 of the spray gun system 10.

In accordance with one aspect of the present invention, an air cap for an air-assisted spray nozzle assembly or air nozzle includes a body form by a housing having an inner surface which defines a plurality of apertures. The plurality of apertures is configured to pass a pressurized medium or air therethrough. The plurality of apertures includes at least one non-circular orifice in the air cap through which the pressurized medium or air passes through.

In accordance with another aspect of the present invention, an air cap for a spray nozzle assembly includes a housing having an inlet end engageable to a discharge or spraying end of a spray gun, and an outlet end on an opposite side of the inlet end. The outlet end has a plurality of apertures in an inside surface of the outlet end such that at least one of the plurality of apertures has a non-circular boundary, such as an elliptical-like boundary, on the inside surface of the outlet end.

In a further aspect of the present invention, a spray gun system is disclosed. The spray gun system includes a gun body adapted to receive a pressurized fluid, such as paint, and discharge the pressurized fluid at a nozzle end having an apertured tip. The system also includes a nozzle assembly connected to a nozzle end of the gun body. The nozzle assembly includes an air cap having a pair of non-circular apertures on an inside surface of the air cap. Each of the non-circular apertures are in communication with a plurality of discharge apertures that discharge pressurized gas or a medium toward a pressurized fluid to form a generally oval-shaped spray pattern.

In yet another aspect of the present invention, an air cap for an air-assisted spray nozzle assembly of a spray gun includes a body having a cylindrical sidewall and an end wall connected to the cylindrical sidewall. The end wall has an inside surface, an outside surface and at least one aperture therein. The inside surface of the end wall has a non-circular opening in fluid communication with the at least one aperture, and the outside surface of the end wall has a plurality of openings in fluid communication with the at least one aperture.

The present invention has been described in terms of the preferred embodiment, and it is recognized that equivalents, alternatives, and modifications, aside from those expressly stated, are possible and within the scope of the appending claims.

What is claimed is:

1. An air cap for an air-assisted spray nozzle assembly, the air cap comprising a body formed by a housing having an inner surface which defines a plurality of apertures configured to pass a pressurized medium therethrough, the plurality of apertures including at least one non-circular orifice through which the pressurized medium passes wherein the non-circular orifice is defined by an arcuate wall contiguous with a cylindrical sidewall, a pair of opposing sidewalls extending inwardly from the cylindrical sidewall and a wall connecting the pair of opposing sidewalls.

2. The air cap of claim 1 wherein the at least one non-circular orifice has a D shape.

3. The air cap of claim 1 wherein non-circular orifice extends into an air horn that extends from the body of the air cap and has a plurality of discharge openings in communication with the non-circular orifice.

4. The air cap of claim 3 wherein the plurality of discharge openings includes individual passages within the air horn in communication within the air horn with the non-circular orifice wherein at least one of the individual passages is non-parallel to another.

5. The air cap of claim 1 wherein the plurality of apertures includes two non-circular orifices that are arranged on opposed sides of a longitudinal axis across the body.

6. The air cap of claim 1 further comprising a pair of air horns attached to an outer radial wall of the air cap to discharge the pressurized medium passing through the two non-circular orifices.

7. The air cap of claim 6 wherein the pair of air horns are arranged on opposed sides of the body to direct a stream of pressurized fluid therebetween.

8. An air cap for a spray nozzle assembly comprising:

a housing having an inlet end engageable to a discharge end of a spray gun, and an outlet end on an opposite side of the inlet end and the inlet end having a plurality of apertures in an inside surface thereof;

wherein at least one of the plurality of apertures has a non-circular boundary of the inside surface of the inlet end; and wherein the non-circular boundary is defined by an arcuate wall contiguous with a cylindrical sidewall, a pair of opposing sidewalls extending inwardly from a cylindrical sidewall and a wall connecting the pair of opposing sidewalls.

9. The air cap of claim 8 wherein the non-circular boundary has a D shape.

10. The air cap of claim 8 wherein two of the apertures have non-circular boundaries and wherein the air cap has a pair of opposing air horns configured to receive a pressurized medium toward one another, the air horns communicating from the non-circular bounded apertures and direct at least a portion of the pressurized medium.

11. The air cap of claim 10 wherein each air horn has a cavity therein located between a respective non-circular opening and one or more air horn discharge openings, the cavity configured to reduce turbulence of the pressurized medium passing therethrough.

12. The air cap of claim 10 wherein each air horn has a plurality of passages therethrough connecting a non-circular aperture to a plurality of discharge openings where at least one passage is at an angle to another to discharge the pressurized medium in different directions.

13. The air cap of claim 12 wherein each air horn has two parallel passages and one non-parallel passage.

14. A spray gun system comprising:

a gun body adapted to receive a pressurized fluid and discharge the pressurized fluid at a nozzle end;

a nozzle assembly connected to the nozzle end of the gun body, the nozzle assembly including an air cap having a pair of non-circular apertures on an inside surface of the air cap, each non-circular aperture in communication with a plurality of discharge apertures discharging pressurized gas toward the pressurized fluid to form a generally oval-shaped spray pattern; and wherein an inlet of each non-circular aperture has a boundary defined by an arcuate shaped wall connected to one or more linear shaped walls.

15. The spray gun system of claim 14 wherein the air cap includes a pair of air horns extending outwardly from the air cap, wherein each air horn includes a plurality of passages having openings that are directed generally perpendicular to the non-circular aperture to discharge pressurized gas from the nozzle assembly toward the pressurized fluid.

16. The spray gun system of claim 15 wherein each air horn includes at least one passage that is non-parallel to the plurality of passages that are directed generally perpendicular to the non-circular aperture to direct a portion of pressurized gas in a different direction.

17. An air cap for an air-assisted spray nozzle assembly, the air cap comprising a body having a cylindrical sidewall and an end wall connected to the cylindrical sidewall, the end wall having an inside surface, an outside surface, and at least one aperture therein, the inside surface of the end wall having a non-circular opening in fluid communication with the at least one aperture, and the outside surface of the end wall having a plurality of openings in fluid communication with the at least one aperture, wherein the non-circular opening is defined by an arcuate wall contiguous with the cylindrical sidewall, a pair of opposing sidewalls extending inwardly from the cylindrical sidewall and a wall connecting the pair of opposing sidewalls.

18. The air cap of claim 17 wherein the wall connecting the pair of opposing sidewalls forms a 90° angle at the connections.

19. The air cap of claim 17 wherein the at least one aperture extends into an air horn having the plurality of openings therein, wherein the plurality of openings have a discharge end that is substantially perpendicular to the inside surface.

20. The air cap of claim 19 wherein the plurality of openings have passages in communication with the at least one aperture wherein at least one passage is non-parallel to another passage.

21. A nozzle assembly connected to a gun body, the nozzle assembly including:

an air cap having a pair of air horns disposed on an outside surface of the air cap, wherein each air horn has a discharge opening;

the air cap further including an inside surface having at least two non-circular apertures, each non-circular aperture in communication with an air horn discharge opening; and wherein each non-circular aperture has a cross-sectional shape symmetrical with a cross-sectional shape of an air horn.

* * * * *

UNITED STATES PATENT AND TRADEMARK OFFICE

CERTIFICATE OF CORRECTION

PATENT NO. : 6,669,112 B2
DATED : December 30, 2003
INVENTOR(S) : Reetz, III et al.

It is certified that error appears in the above-identified patent and that said Letters Patent is hereby corrected as shown below:

Column 1,
Line 63, insert the word -- generally -- before “oval-spray”;

Column 3,
Line 47, delete the word “to” and substitute therefor -- the --.

Signed and Sealed this

Twenty-fourth Day of February, 2004

JON W. DUDAS
*Acting Director of the United States Patent and Trademark Office*